United States Patent [19]

Schommler

[11] Patent Number: 4,581,095

[45] Date of Patent: Apr. 8, 1986

[54] ONE-SIDED CORRUGATED CARDBOARD MACHINE

[75] Inventor: Manfred Schommler, Quickborn-Heide, Fed. Rep. of Germany

[73] Assignee: Ingeniorfima Peter Simonsen A/S, Denmark

[21] Appl. No.: 651,355

[22] Filed: Sep. 17, 1984

[30] Foreign Application Priority Data

Oct. 8, 1983 [DE] Fed. Rep. of Germany ..... 3336658

[51] Int. Cl.[4] ..... B31F 1/00; B31F 1/28

[52] U.S. Cl. ..... 156/473; 156/210; 156/285; 156/462; 156/582; 425/369; 425/388; 425/396

[58] Field of Search ..... 156/205, 210, 462, 470, 156/472, 473, 285, 582; 425/369, 388, 396; 29/121.1; 264/286

[56] References Cited

U.S. PATENT DOCUMENTS

| | | | |
|---|---|---|---|
| Re. 31,138 | 2/1983 | Tokuno | 156/473 |
| 2,068,155 | 1/1937 | Swift, Jr. | 156/473 |
| 4,251,313 | 1/1981 | Abe | 156/210 X |
| 4,270,969 | 6/1981 | Kelley | 156/473 |
| 4,368,094 | 1/1983 | Mayer et al. | 425/369 X |
| 4,447,285 | 5/1984 | Lussana et al. | 156/473 |

FOREIGN PATENT DOCUMENTS

| | | |
|---|---|---|
| 2823674 | 9/1980 | Fed. Rep. of Germany . |
| 2840150 | 5/1981 | Fed. Rep. of Germany . |

*Primary Examiner*—Edward Kimlin
*Assistant Examiner*—Ramon R. Hoch
*Attorney, Agent, or Firm*—Harness, Dickey & Pierce

[57] ABSTRACT

One-sided corrugated cardboard machine comprising a first fluted roller and a second fluted roller in meshing engagement with each other and between which a web of cardboard is introduced to be corrugated, the second fluted roller being provided in the circumferential outer surface thereof with several annular grooves arranged at axially spaced intervals, and a device which during the movement of the web of corrugated cardboard from the position of engagement between the second fluted roller and the first fluted roller to the position of engagement between the second fluted roller and an auxiliary roller biases the web of corrugated cardboard with a vacuum pressure via the suction grooves, wherein the second fluted roller has suction boxes associated therewith one each at the inlet and the outlet of the web of cardboard, said suction boxes respectively extending only over a small portion of the circumferential region of the fluted roller not covered by the web of corrugated cardboard and being closed on the side facing the fluted roller except for small openings in the region of the suction grooves, and wherein on the sides of the suction boxes facing each other sealing elements are respectively engaging within the suction grooves.

21 Claims, 3 Drawing Figures

ONE-SIDED CORRUGATED CARDBOARD MACHINE

The invention relates to a one-sided corrugated cardboard machine comprising a first fluted roller and a second fluted roller in meshing engagement with each other and between which a web of paper is introduced to be corrugated, the second roller having several annular suction grooves arranged at spaced intervals axially of the roller, and a device which during the movement of the web of corrugated cardboard from the position of engagement between the second fluted roller and the first fluted roller to the position of engagement between the second fluted roller and an auxiliary roller biases said web of corrugated cardboard with a vacuum pressure via the suction grooves.

Such a one-sided corrugated cardboard machine is known (U.S. Pat. No. 2,068,155). Extending into the suction grooves in the circumferential section of the second fluted roller which is not covered by the web of corrugated paper, are suction pipes by which a vacuum is created in the suction grooves. To avoid air entering through leaks the suction pipes possibly must fittingly engage within the suction grooves. This, however, may result in undesirable wear.

As the suction grooves may have a negative influence on the quality of the corrugated cardboard, it is aimed at selecting them to be as small as possible. It has therefore also become known already not to have the width of suction grooves exceed a certain value (German disclosure letter No. 2 952 563).

Finally, it is also known to arrange a suction box over the circumferential section of the second fluted roller which is not covered by the web of corrugated cardboard (German patent letter No. 2 840 150). Such a vacuum device operates relatively satisfactorily because wear phenomena as occuring with the individual suction pipes will not occur or will occur in a substantially reduced degree. What is disadvantageous, however, is that the entire second fluted roller is covered and, thus, is no longer accessible. To obtain access to the second fluted roller the entire suction box must be removed. A sealing between the suction box and the second fluted roller is effected only along the circumference of the suction box. There exists, therefore, the danger of air entering through leaks. Finally, the substantial dimensions of the suction box and the closure plates arranged therein which may be introduced selectively into the suction grooves, require heating of the vacuum device so as to counteract the problem of different thermal expansion.

It is therefore the object of the invention to provide a onesided corrugated cardboard machine, in which the vacuum device may be fitted and removed in a simple manner and will give access to the fluted roller. Furthermore, the vacuum device is intended to be effective to cause a particularly favourable sealing of the fluted roller.

This object is attained with a one-sided corrugated cardboard machine of the type mentioned at the beginning in that the second fluted roller has associated thereto one suction box each at the entrance and exit of the web of cardboard, said suction boxes respectively extending only over a small portion of the circumferential section of the fluted roller not covered by the web of corrugated cardboard and being closed on the side facing the fluted roller except for a small opening adjacent the suction grooves, and that on the sides of the suction boxes facing each other sealing elements are respectively engaging within the suction grooves.

The corrugated cardboard machine according to the invention in view of the vacuum device constitutes a third alternative to the solutions according to the U.S. Pat. No. 2,068,155 and the German patent letter No. 2,840,150. Same as with the U.S. Pat. No. 2,068,155, only the suction grooves over the openings in the bottom of the suction boxes are connected to the vacuum pressure in an aimed manner; in contrast to the known machine, however, the suction openings do not project into the grooves but terminate above the suction grooves, so that the above mentioned wear problems will not arise. But again, as in the case of the known machine, a local suction is taking place adjacent the suction grooves near the inlet and the exit of the web of corrugated cardboard. Furthermore in conformity with the above, the openings in the suction boxes are connected to a common vacuum channel, which may be compared to the connection pipe of the suction tubes of the U.S. Pat. No. 2,068,155, to secure supply in a simple manner.

As with the invention the suction openings associated with the grooves do not engage within the suction grooves proper, sealing means must be provided in order to prevent pressure balancein the respective region of the grooves between the suction boxes.

As the suction boxes are closed downwardly except for the suction openings, an effective sealing is effected in the region of the second fluted roller between the web of cardboard and the sealing elements.

As the dimensions of the suction device according to the invention remain within limits, a special heating as required for instance in the case of the machine according to German patent letter No. 2 840 150 may be dispensed with. The suction device according to the invention, above all, makes possible an access to the fluted roller at any time, in order to examine, for example, the condition of the corrugation. The corrugation is known to be subject to wear, so that the fluted rollers must be replaced from time to time, if a reduction in the quality of the corrugated cardboard cannot be tolerated. Also the mounting and demounting of the suction device according to the invention is relatively simple and inexpensive.

According to one embodiment of the invention provision is made for the wall of the suction boxes facing the second fluted roller to consist of soft material. An unintended contact with the second fluted roller thus will not result in any impairment thereof.

According to another embodiment of the invention provision is made for the side of the suction box wall facing the fluted roller to be formed with a corrugation or toothing. In this manner, a sort of labyrinth type sealing is obtained, whereby the sealing effect is still improved.

As the web of corrugated cardboard may have different widths, provision is made in accordance with another embodiment of the invention for the openings at least to the ends of the second fluted roller to have a slide or flap associated therewith in the suction box which is connected to an actuation device. By actuation of the flap the associated suction groove may be separated from the vacuum. Thereby, the required amount of suction air will be reduced.

Various possibilities may be imagined of actuating the slides or flaps either automatically or by hand. One such possibility in accordance with the invention consists in that the suction boxes at the side facing the web of corrugated cardboard support spring-biased levers respectively connected to a flap. The associated levers are urged against the wall of the box over the width of the corrugated cardboard web, so that they take care of the opening of the associated suction openings via a suitable linkage. Those levers which are not being urged thus are effective to cause an a closing of the suction openings.

As already mentioned, a pressure balance over the groove region must be avoided between the suction boxes. According to an embodiment of the invention the sealing elements are fastened at the suction boxes. As the fluted roller may experience substantial changes in length with different temperatures, provision is made in another embodiment of the invention for the sealing elements comprising metal plates or sheet metal members, for example, to be supported axially displaceably. With a large number of sealing elements this may be relatively costly. Therefore, provision is made in an alternative embodiment of the invention for a limited number of sealing elements to be supported at an axially displaceable carrier.

In many cases sheet metal members introduced into the suction grooves are also utilised on the exit side of the web of cardboard, in order to obtain a facilitated detachment from the second fluted roller. Such sheet metal members or plates, too, may be retained at an axially movable carrier according to the proposal of the invention.

So as to be able to remove the suction boxes also from the position of a second fluted roller, provision is made in another embodiment of the invention for the suction boxes to be connected to a lifting arrangement fitted at the machine stand.

The invention will be explained in more detail in the following by way of drawings.

Figure 1:
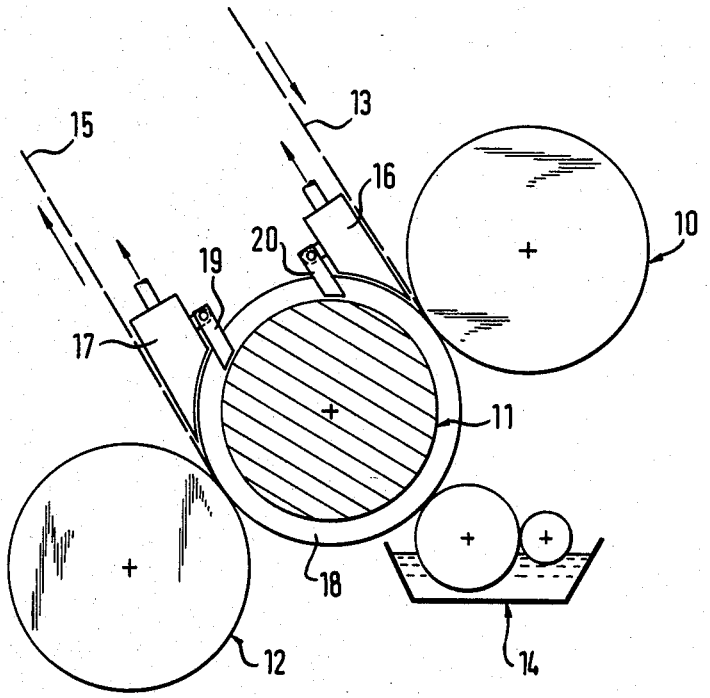
FIG. 1 shows a diagrammatic view of a one-sided corrugated cardboard machine according to the invention.

Prior to enlarging in more detail on the individual representations shown in the drawings, it is to be stated that each of the described features is of inventively essential importance by itself and in connection with the features of the claims.

The drawings are extremely schematic and not to scale.

FIG. 1 shows a schematic view of a known-per-se one-sided corrugated cardboard machine comprising a first fluted roller 10, a second fluted roller 11 as well as an auxiliary roller 12 arranged on the side opposite to the first fluted roller 10. A web of cardboard 13 is supplied to the nip between the fluted rollers 10, 11 and is formed in the roll nip. An applicator means 14 associated with the second fluted roller applies glue to the crests of the web of corrugated cardboard 14. The auxiliary roller 13 serves to press a covering web (not shown) in contact onto the corrugated web. The one-sided web of corrugated cardboard 15 leaves the machine in the direction of the arrow 16.

Respectively arranged on the inlet and outlet sides of the web of corrugated cardboard are relatively narrow suction boxes 16 and 17, respectively, which are each connected to a suction source. The suction boxes 16, 17 create a vacuum in individual suction boxes of the second fluted roller 11 in a manner still to be described in more detail in the following, one of said suction grooves being shown at 18. Sealing sheet metal members 19, 20 fitted at the sides of the suction boxes 16, 17 facing each other project into the grooves 18 in order to seal the region of grooves disposed between the suction boxes 16, 17, so that a pressure balance cannot take place via said region.

Figure 2:
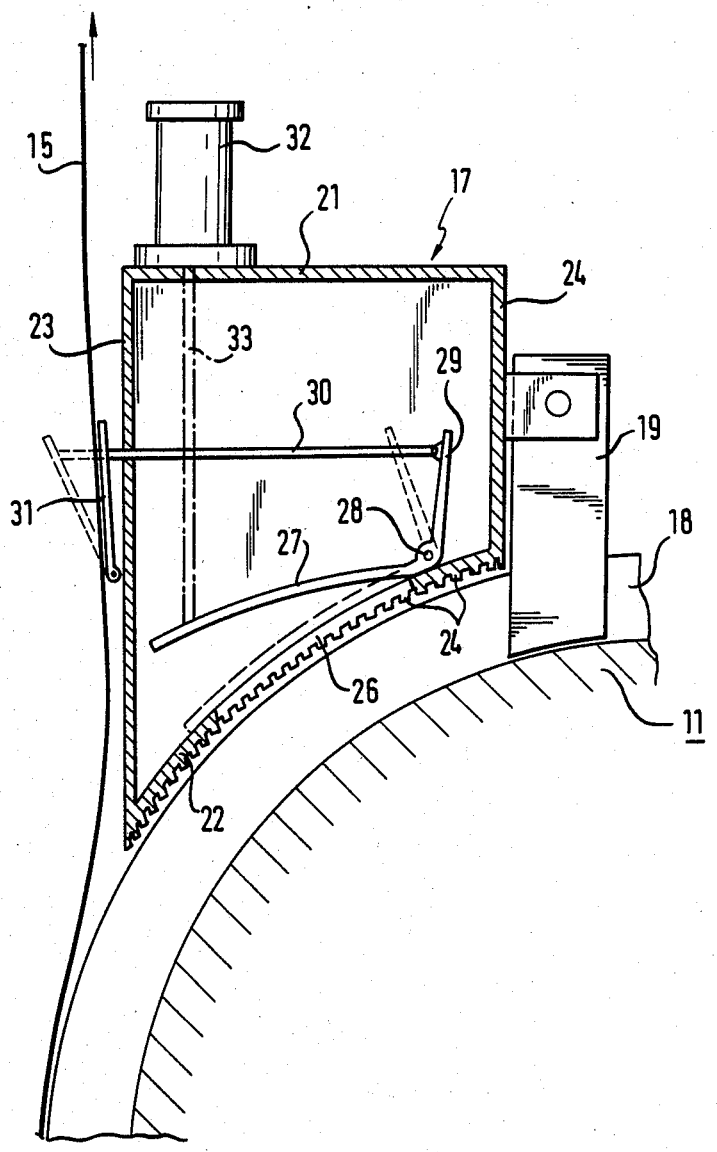
FIG. 2 shows a sectional view of a portion of the suction device of the corrugated cardboard machine according to FIG. 1.

In FIG. 2 the suction box 17 is shown in more detail. It has an upper wall 21, a lower wall 22 as well as side walls 23, 24. It is furthermore closed at the end faces, which, however, is not shown. Also the connection of the inner space of the suction box 17 to a vacuum source is not shown. The lower wall 22 is curved in correspondence with the radius of the fluted roller 11. It consists of a relatively soft material in order to avoid impairment of the fluted roller 11 by inadvertent contact with the corrugation. On its side facing the fluted roller 11 the lower wall 22 is provided with a toothing 24 ("mouse teeth"), forming with the fluted roller a sort of labyrinth seal.

A plurality of slots 26 are arranged in the longitudinal direction of the suction box 17 which are respectively associated with a suction groove 18. Via said slots 26 the vacuum is built up in the grooves 18.

Associated with the slots 26 are flaps 27 which are articulated at 28 to the inner surface of the lower wall 22 comprising an elongated arm 29 having an adjusting rod 30 articulated thereto said rod projecting outwards above an opening in the wall 23 and connected there to a further level 31. The flap 27 and the levers connected thereto, respectively, are spring-biased in such a manner that normally the flap 27 closes the suction slot 26 (representation in dashed lines). The lever 31 is disposed between the outer surface of the box wall 23 and the web of corrugated cardboard 15 and is therefore pressed against the wall of the box by the latter thereby maintaining the flap 27 in its opened condition (shown in solid lines). In this manner, an automatic adaptation is taking place to the width of the web of corrugated cardboard. Suction slots and suction grooves 18, respectively, which are not needed are therefore not biased with a vacuum.

The flaps 27 may alternatively have associated thereto an adjusting cylinder 32 which is connected to the flap 27 via an adjusting rod 33 (shown in dash-dotted lines).

Figure 3:
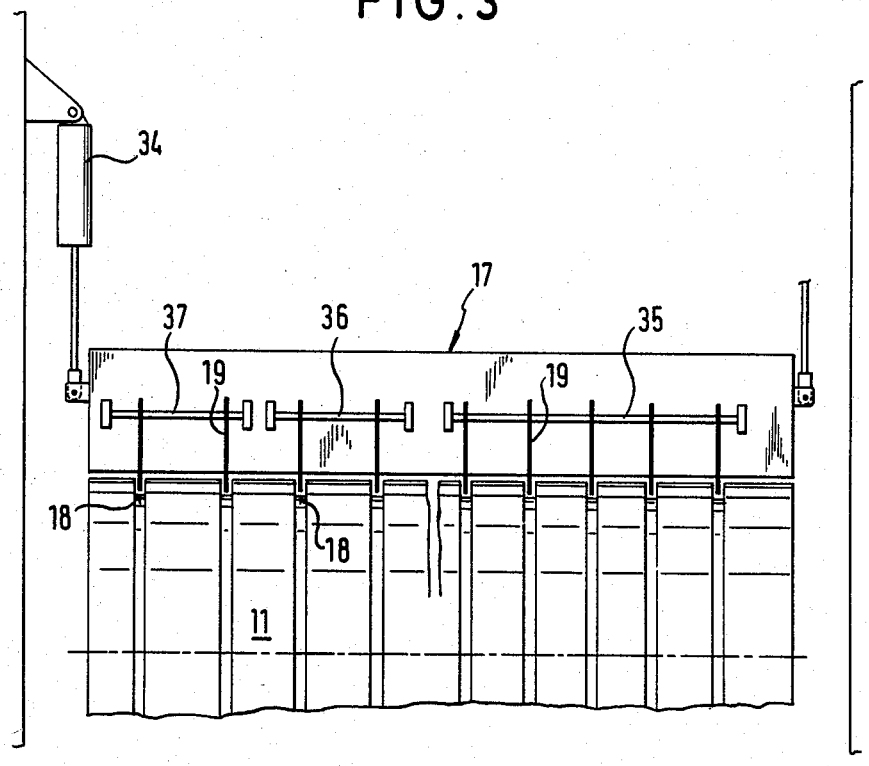
FIG. 3 shows a diagrammatic view of the second fluted roller including a longitudinal sectional view of the suction box.

From FIG. 3 it may be recognized that the suction box 17 extends the entire length of the second fluted roller 11. It may be removed from the fluted roller 11 by means of lifting cylinders one of them being shown at 34. The lifting cylinder 34 is articulated to the machine stand not shown in any more detail.

It may furthermore be recognized from FIG. 3 that each suction groove 18 has associated thereto a sealing sheet metal member 19. The sealing sheet metal members are arranged in groups with each group fitted at a carrier rod 35, 36 and 37, respectively, which for their part are supported to be capable of axial movement at the suction box 17 in a manner not shown in any more detail. Thereby, a certain adaptation is possible to different degrees of thermal expansion of the fluted roller and thus to the position of the grooves 18.

I claim:

1. A one-sided corrugated cardboard machine comprising a first fluted roller and a second fluted roller in meshing engagement with each other and between which a web of cardboard is introduced to be corrugated, and an auxiliary roller spaced from said first fluted roller and juxtaposed to said second fluted roller, said second fluted roller being provided in the circumferential outer surface into which extend several circumferentially extending annular suction grooves in axial spaced arrangement, and a device for biasing the web of corrugated cardboard into engagement with the portion of said second fluted roller in the area between said first fluted roller and said auxiliary roller in the direction of cardboard travel with a vacuum pressure via said suction grooves, characterized by circumferentially spaced suction boxes associated with said second fluted roller on the side of said second fluted roller not covered by the web of corrugated cardboard and adjacent said first fluted roller and said auxiliary roller, respectively, each of said suction boxes extending only over substantially less than the full portion of the circumferential region of the uncovered side of said second fluted roller and being closed on the side of said suction boxes facing said second fluted roller except for small openings spaced outwardly from the outer periphery of said second fluted roller in the region of said suction grooves and radially outwardly therefrom, and the sides of said suction boxes facing each other having sealing elements extending into said suction grooves in sealing relation thereto, whereby said sealing elements effectively seal the exposed portions of the suction grooves which extend between said suction boxes so that the loss of vacuum pressure is prevented.

2. A corrugated cardboard machine according to claim 1, characterized in that the wall of the suction boxes facing the second fluted roller consists of soft material.

3. A corrugated cardboard machine according to claim 1 characterized in that the side of the suction box wall facing the fluted roller is provided with a corrugation.

4. A corrugated cardboard machine according to claim 1, characterized in that the small openings have control means associated therewith in the suction box for selectively closing said openings and which are connected with an actuating means.

5. A corrugated cardboard machine according to claim 4, characterized in that the suction boxes support spring-biased levers at the side facing the web of corrugated cardboard, said levers being respectively connected to control said control means.

6. A corrugated cardboard machine according to claim 1, characterized in that the sealing elements are fastened at the suction boxes .

7. A corrugated cardboard machine according to claim 1, characterized in that the sealing elements are supported to be capable of axial displacement.

8. A corrugated cardboard machine according to claim 7, characterized in that a limited number of sealing elements is supported at an axially displaceable carrier .

9. A corrugated cardboard machine according to, characterized in that the suction boxes are connected to a lifting device fitted at the machine frame.

10. A corrugated cardboard machine according to claim 2, characterized in that the side of the suction box wall facing the fluted roller is provided with a corrugation.

11. A corrugated cardboard machine according to claim 2, characterized in that the small openings have control means associated therewith in the suction box for selectively closing said openings and which are connected with an actuating means.

12. A corrugated cardboard machine according to claim 3, characterized in that the small openings have control means associated therewith in the suction box for selectively closing said openings and which are connected with an actuating means.

13. A corrugated cardboard machine according to claim 10, characterized in that the small openings have control means associated therewith in the suction box for selectively closing said openings and which are connected with an actuating means.

14. A corrugated cardboard machine according to claim 11, characterized in that the suction boxes support spring-biased levers at the side facing the web of corrugated cardboard, said levers being respectively connected to control said control means.

15. A corrugated cardboard machine according to claim 12, characterized in that the suction boxes support spring-biased levers at the side facing the web of corrugated cardboard, said levers being respectively connected to control said control means.

16. A corrugated cardboard machine according to claim 13, characterized in that the suction boxes support spring-biased levers at the side facing the web of corrugated cardboard, said levers being respectively connected to control said control means.

17. A corrugated cardboard machine according to claim 2, characterized in that the sealing elements are fastened at the suction boxes.

18. A corrugated cardboard machine according to claim 3, characterized in that the sealing elements are fastened at the suction boxes.

19. A corrugated cardboard machine according to claim 4, characterized in that the sealing elements are fastened at the suction boxes.

20. A corrugated cardboard machine according to claim 5, characterized in that the sealing elements are fastened at the suction boxes.

21. A corrugated cardboard machine according to claim 1 wherein each of the suction boxes extends a substantially greater width than the width of the suction grooves whereby each suction box lies over a plurality of suction grooves and has respective openings cooperating with each of the suction groove openings.

* * * * *

UNITED STATES PATENT AND TRADEMARK OFFICE

CERTIFICATE OF CORRECTION

PATENT NO. : 4,581,095

DATED : April 8, 1986

INVENTOR(S) : Manfred Schommler

It is certified that error appears in the above-identified patent and that said Letters Patent is hereby corrected as shown below:

Column 1, line 38, "occuring" should be -- occurring --.

Column 1, line 54, "onesided" should be -- one-sided --.

Column 3, line 9, delete "an".

Column 4, line 36, "level" should be -- lever --.

Column 6, line 8, claim 9, after "according" insert

-- claim 1 --.

Signed and Sealed this

Eleventh Day of November, 1986

*Attest:*

DONALD J. QUIGG

*Attesting Officer* *Commissioner of Patents and Trademarks*